US007460143B2

(12) United States Patent
Yamamoto et al.

(10) Patent No.: US 7,460,143 B2
(45) Date of Patent: Dec. 2, 2008

(54) THERMAL PRINTHEAD WITH A RESISTOR LAYER AND METHOD FOR MANUFACTURING SAME

(75) Inventors: Tadashi Yamamoto, Kyoto (JP); Shinobu Obata, Kyoto (JP); Kanjou Ishibashi, Amagi (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/571,876

(22) PCT Filed: Sep. 16, 2004

(86) PCT No.: PCT/JP2004/013522

§ 371 (c)(1),
(2), (4) Date: Mar. 15, 2006

(87) PCT Pub. No.: WO2005/025877

PCT Pub. Date: Mar. 24, 2005

(65) Prior Publication Data

US 2006/0280539 A1 Dec. 14, 2006

(30) Foreign Application Priority Data

Sep. 16, 2003 (JP) ..... 2003-323061

(51) Int. Cl.
*B41J 2/34* (2006.01)
*B41J 2/335* (2006.01)

(52) U.S. Cl. ..... 347/200; 347/204; 347/202

(58) Field of Classification Search ..... 347/56, 347/62–63, 200–204, 206, 208
See application file for complete search history.

(56) References Cited

U.S. PATENT DOCUMENTS

| | | | | |
|---|---|---|---|---|
| 4,259,564 A * | 3/1981 | Ohkubo et al. | ..... | 347/208 |
| 5,917,531 A * | 6/1999 | Nagahata et al. | ..... | 347/202 |
| 6,424,367 B1 | 7/2002 | Obata et al. | ..... | 347/208 |

FOREIGN PATENT DOCUMENTS

| | | | |
|---|---|---|---|
| JP | 2-70457 | 9/1990 | |
| JP | 05-212888 A * | 8/1993 | |
| JP | 8-310024 | 11/1996 | |
| JP | 11-314390 | 11/1999 | ..... 347/208 |

* cited by examiner

*Primary Examiner*—Juanita D Stephens
(74) *Attorney, Agent, or Firm*—Hamre, Schumann, Mueller & Larson, P.C.

(57) ABSTRACT

A thermal printhead (A1) comprises an insulating substrate (1), a common electrode (31) which is formed on the insulating substrate (1) and includes a plurality of comb teeth (31*a*), a plurality of individual electrodes (41) formed on the insulating substrate (1), and a resistor layer (51) formed on the insulating substrate (1) and electrically connected to the comb teeth (31*a*) and the individual electrodes (41). The resistor layer (51) comprises a thin film, whereas the common electrode (31) and the individual electrodes (41) comprise a thick film.

4 Claims, 8 Drawing Sheets

THERMAL PRINTHEAD WITH A RESISTOR LAYER AND METHOD FOR MANUFACTURING SAME

TECHNICAL FIELD

The present invention relates to a thermal printhead and a method for manufacturing the same.

BACKGROUND ART

Conventionally, as thermal printheads, a thick-film thermal printhead (See Patent Document 1 below) and a thin-film thermal printhead (See Patent Document 2 below) are known.

Patent document 1: JP-A-H11-314390

Patent Document 2: JP-A-H08-310024

FIGS. 9 and 10 show an example of prior art thick-film thermal printhead. The thermal printhead B1 includes an insulating substrate 101, a partial glaze layer 102, a common electrode 103, a plurality of individual electrodes 104, a resistor layer 105 and a protective layer 106. The common electrode 103 includes a plurality of comb teeth 103*a*. Each of the individual electrodes 104 includes a front end positioned between adjacent two comb teeth 103*a* and the opposite end connected to a drive IC (not shown). Both of the common electrode 103 and the individual electrodes 104 are formed by thick-film printing using gold resinate paste. The resistor layer 105, which is in the form of an elongated strip, is formed by thick-film printing so that the resistor layer partially covers the comb teeth 103*a* and the individual electrodes 104 alternately.

In printing an image using the thermal printhead B1, current is caused to flow between each of the selected individual electrodes 104 and the adjacent two comb teeth 103*a*, whereby the portion 105*a* (hatched portion in FIG. 9 ) of the resistor layer 105 sandwiched between the two comb teeth 103*a* is heated. As a result, a predetermined portion of heat sensitive paper or an ink ribbon is heated, whereby printing is performed.

FIGS. 11 and 12 show an example of prior art thin-film thermal printhead. The thermal printhead B2 includes an insulating substrate 111, a partial glaze layer 112, a common electrode 113 a plurality of individual electrodes 114, a resistor layer 115 and a protective layer 116. The resistor layer 115 is formed, by sputtering, as a thin film extending over the partial glaze layer 112 and the insulating substrate 111. The common electrode 113 including the comb teeth 113*a* and the individual electrodes 114 are provided by forming a conductive thin film of A1 on the resistor layer 115 by sputtering and then patterning the conductive thin film by etching using photolithography. The front end of each comb tooth 113*a* and the front end of the corresponding individual electrode 114 face and are spaced from each other, and the exposed portion of the resistor layer 115, which is sandwiched between the comb tooth 113*a* and the individual electrode 114, serves as a heating portion 115*a*.

In performing printing using the thermal printhead B2, the drive IC (not shown) causes current to flow between each of the selected individual electrodes 114 and the comb tooth 113*a* facing the individual electrode, whereby the heating portion 115*a* of the resistor layer 115 is heated.

However, the prior art thermal printheads B1 and B2 shown in FIGS. 9-12 have the following drawbacks.

In the thick-film thermal printhead B1, since the resistor layer 105 is a thick film, the heat capacity of the resistor layer 105 itself is large. Therefore, when the ON/OFF switching speed of energization is increased, the corresponding heating and heat dissipation at a high speed is difficult. When the responsiveness to the heating and heat dissipation is not sufficient, problems such as trailing or a blur of a printing dot may be caused in high speed printing or high definition printing.

Further, the resistor layer 105 comprising a thick film projects largely upward as compared with the common electrode 103 and the individual electrodes 104. Therefore, during the printing, the protective layer 106 covering the resistor layer 105 is pressed against heat sensitive paper or an ink ribbon with a high pressing force, and the friction may cause sticking which may result in unstable sheet feeding or abnormal noise. The sticking is likely to occur particularly when the ink ribbon is heated to a high temperature due to the heating of the resistor layer 105 and the ink component is molten.

In the thin-film thermal printhead B2, the common electrode 113 and the individual electrodes 114 are provided by forming a conductive layer on the resistor layer 115 and then etching only the conductive layer into a predetermined pattern while leaving the resistor layer 115. To enable such etching, the conductive layer is often made of Al, for example. However, electrodes made of Al are inferior to electrodes made of e.g. Au in corrosion resistance. Therefore, in the long-term use, the common electrode 113 and the individual electrodes 114 may be chemically or electrically affected to be corroded, which may result in contact failure or disconnection. Therefore, the durability and reliability of the thermal printhead B2 is not sufficient.

Moreover, the common electrode 113, the individual electrodes 114, the resistor layer 115 and the protective layer 116 are formed by sputtering as thin laminated films. Generally, sputtering is performed in a vacuum chamber and requires processing time corresponding to the intended film thickness. To form the thin films one upon another, the sputtering operation need be performed repetitively. Therefore, it is difficult to shorten the operation time, which leads to low manufacturing efficiency.

DISCLOSURE OF THE INVENTION

An object of the present invention is to provide a thermal printhead which is suitable for high speed and high definition printing, is less likely to cause sticking and has excellent durability and reliability.

Another object of the present invention is to provide a manufacturing method capable of manufacturing such a thermal printhead properly with improved manufacturing efficiency.

According to a first aspect of the present invention, there is provided a thermal printhead comprising an insulating substrate, a common electrode which is formed on the insulating substrate and includes a plurality of comb teeth, a plurality of individual electrodes formed on the insulating substrate, and a resistor layer formed on the insulating substrate and electrically connected to the comb teeth and the individual electrodes. The thermal printhead is characterized in that the resistor layer comprises a thin film, whereas the common electrode and the individual electrodes comprise a thick film.

The "thin film" in the present invention means a film formed by thin-film forming techniques such as sputtering, vacuum evaporation, CVD or plating, for example. On the other hand, the "thick film" means a film formed by techniques other than the above-described thin-film forming techniques, such as one formed by thick-film printing. Preferably, the thin film has a film thickness of 0.05 to 0.2 μm, whereas the thick film has a film thickness of 0.3 to 1.0 μm.

Preferably, the resistor layer is in the form of an elongated strip and partially covers the comb teeth of the common electrode and the individual electrodes alternately.

Preferably, the comb teeth and the individual electrodes have respective front ends facing and spaced from each other, and the resistor layer is divided into a plurality of electrically-separated resistor portions correspondingly to the comb teeth and the individual electrodes. Each of the resistor portions is positioned between the front end of one of the comb teeth and the front end of the corresponding one of the individual electrodes.

Preferably, the resistor layer, the common electrode and the individual electrodes are covered by a protective layer.

According to a second aspect of the present invention, there is provided a method for manufacturing a thermal printhead, comprising the steps of forming a common electrode including a plurality of comb teeth, and a plurality of individual electrodes on an insulating substrate, and forming a resistor layer for electrical connection to the common electrode and the individual electrodes. The manufacturing method is characterized in that the step of forming the common electrode and the plurality of individual electrodes comprises forming a thick film of conductive material, whereas the step of forming the resistor layer comprises forming a thin film of resistive material.

Preferably, the step of forming the common electrode and the plurality of individual electrodes is so performed that the thick film has a film thickness of 0.3 to 1.0 μm, whereas the step of forming the resistor layer is so performed that the thin film has a film thickness of 0.05 to 0.2 μm.

Preferably, the step of forming the common electrode and the plurality of individual electrodes comprises thick-film printing of the conductive material.

Preferably, the step of forming the resistor layer is performed by a technique selected from the group consisting of sputtering, vacuum evaporation, CVD and plating.

Other features and advantages of the present invention will become apparent from the detailed description given below with reference to the accompanying drawings.

BEST MODE FOR CARRYING OUT THE INVENTION

Preferred embodiments of the present invention will be described below in detail with reference to the accompanying drawings.

Figure 1:
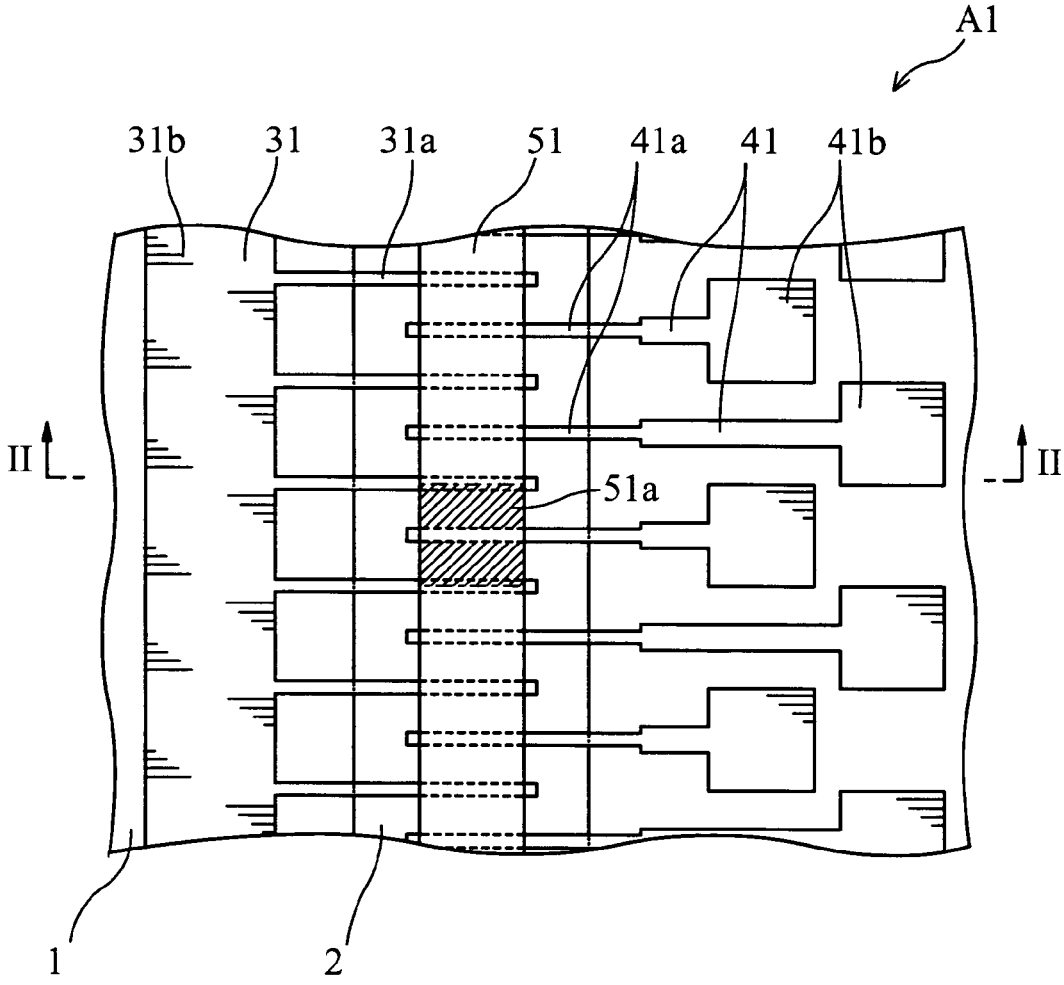
FIG. 1 is a plan view showing the principal portion of a thermal printhead according to a first embodiment of the present invention.
Figure 2:
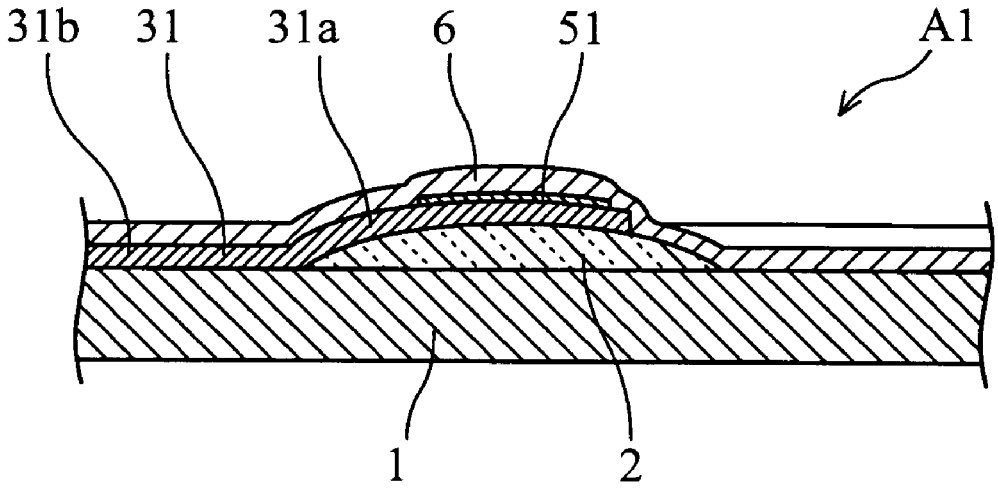
FIG. 2 is a sectional view taken along lines II-II in FIG. 1.

FIGS. 1 and 2 show a thermal printhead A1 according to a first embodiment of the present invention. The thermal printhead A1 includes an insulating substrate 1, a partial glaze layer 2, a common electrode 31, a plurality of individual electrodes 41, a resistor layer 51 and a protective layer 6. The protective layer 6 is not illustrated in FIG. 1.

The insulating substrate 1 is made of alumina ceramic, for example. The partial glaze layer 2 is formed on the insulating substrate 1 to extend in a predetermined direction. The partial glaze layer 2 is formed by printing and baking using amorphous glass paste, for example, and has a curved upper surface bulged upward due to the flowability and surface tension of the glass component in the baking.

As better shown in FIG. 1, the common electrode 31 includes a common line 31*b* extending in the predetermined direction, and a plurality of comb-teeth 31*a* extending from the common line 31*b*. The common line 31*b* and the root portion of each comb tooth 31*a* are formed on the insulating substrate 1, whereas the front end of each comb tooth 31*a* is formed on the partial glaze layer 2. The common electrode 31 comprises a thick film formed by printing and baking gold resinate paste, for example.

The plurality of individual electrodes 41 and the comb-teeth 31*a* are alternately arranged. Each of the individual electrodes 41 has a narrow front end 41*a* and an opposite end provided with a bonding pad 41*b*. Each individual electrode 41 is so formed that part of the front end 41*a* is positioned between two adjacent comb teeth 31*a* on the partial glaze layer 2. The bonding pad 41*b* is formed on the insulating substrate 1 and connected to a drive IC (not shown) via a wire (not shown). The drive IC serves to apply a voltage selectively to each of the individual electrodes 41 to heat the intended portion of the resistor layer 51, which will be described later. Each individual electrode 41 also comprises a thick film formed by printing gold resinate paste, for example.

The resistor layer 51 is in the form of a strip extending in the same direction as the partial glaze layer 2 and covers part of the front end of each tooth 31 and part of the front end 41*a* of each individual electrode 41. With this arrangement, the resistor layer 51 is electrically connected to the common electrode 31 and the individual electrodes 41. The resistor layer 51 comprises a thin film formed by sputtering using $TaSiO_2$ as the material. When a voltage is applied to each of selected individual electrodes 41 by the drive IC, current flows from that individual electrode 41 to the two adjacent comb teeth 31*a* through the resistor layer 51. As a result, the portion of the resistor layer 51 which is sandwiched between the two comb teeth 31*a* (e.g. hatched portion 51*a* in the figure) is heated. In this way, selected portions of the resistor 51 corresponding to the printing pattern are heated, whereby printing is performed.

The protective layer 6 is formed to cover the resistor layer 51, the common electrode 31, the individual electrodes 41, the partial glaze layer 2 and part of the insulating substrate 1. The protective layer 6 comprises a thick film formed by printing and baking glass paste, for example. The protective layer 6 prevents the resistor layer 51, the common electrode 31 and the individual electrodes 41 from coming into direct contact with heat sensitive paper or an ink ribbon and from being chemically or electrically affected, for example. The protective layer 6 is made to have a smooth obverse surface to reduce the friction with the heat sensitive paper during the printing to enable smooth printing.

A method for manufacturing the thermal printhead A1 will be described with reference to FIGS. 3-5.

Figure 3:
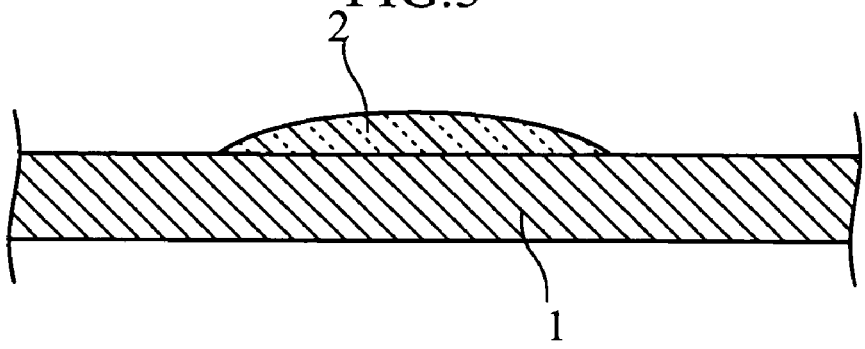
FIG. 3 is a sectional view showing the glaze layer forming step in a method for manufacturing the thermal printhead.

First, as shown in FIG. 3, an insulating substrate 1 is prepared, and a partial glaze layer 2 is formed as a thick film on the upper surface of the insulating substrate 1. The thick-film forming is performed by thick-film printing and baking using glass paste. Due to the surface tension in the fluidization of the glass component in the process of baking the glass paste, the obverse surface of the partial glaze layer 2 becomes a smooth curved surface bulging upward.

Figure 4:
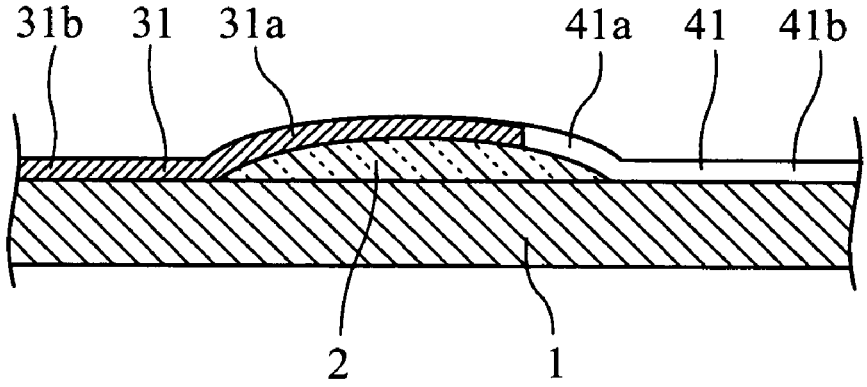
FIG. 4 is a sectional view showing the electrode forming step in the method for manufacturing the thermal printhead.

After the partial glaze layer 2 is formed, a common electrode 31 and a plurality of individual electrodes 41 are formed as a thick film, as shown in FIG. 4. Specifically, by thick-film printing using gold resinate paste, the common electrode 31 including a common line 31*b* and a plurality of comb teeth 31*a*, and the individual electrodes 41 including front ends 41*a* and the bonding pads 41*b* are formed as a pattern. Instead of such patterning in the thick-film printing process, a thick film covering a predetermined region may be formed by thick-film printing and then the thick film thus formed may be patterned by etching using photolithography. The film thickness of the common electrode 31 and the individual electrodes 41 may be 0.3 to 1.0 μm, for example.

Figure 5:
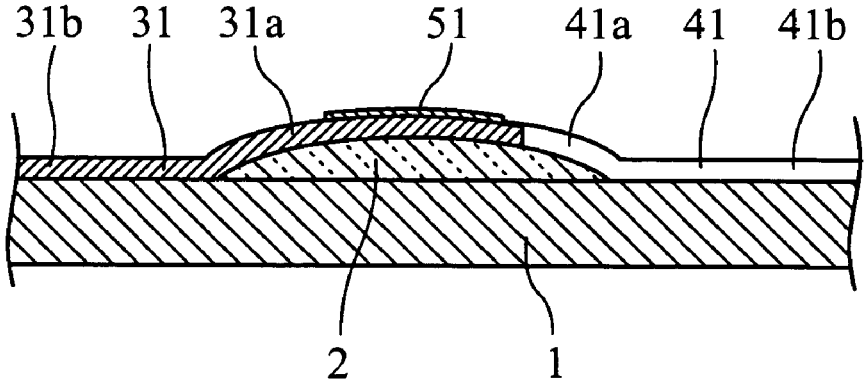
FIG. 5 is a sectional view showing the resistor layer forming step in the method for manufacturing the thermal printhead.

After the common electrode 31 and the individual electrodes 41 are formed, a resistor layer 51 is formed as a thin film, as shown in FIG. 5. Specifically, a mask is provided which includes an opening corresponding to the region where the resistor layer 51 is to be formed. In this state, sputtering using $TaSiO_2$ as the material, for example is performed, whereby the resistor layer 51 in the form of a strip is formed which partially covers each of the comb teeth 31*a* and the front end 41*a* of each individual electrode 41. Instead of the sputtering using a mask, the resistor layer 51 may be provided by forming a resistive layer entirely on the insulating substrate 1 and then etching the resistive layer into a predetermined pattern by photolithography. The film thickness of the resistor layer 5 may be 0.05 to 0.2 μm, for example.

Subsequently, the protective layer 6 as a thick film is formed by thick-film printing and baking of glass paste to cover the resistor layer 51, the common electrode 31, the individual electrodes 41, the partial glaze layer 2 and part of the insulating substrate 1. Thereafter, the process step of electrically connecting the bonding pad 41*b* of each individual electrode 4*l*to the drive IC via a wire, for example, is performed, whereby the thermal printhead A1 shown in FIG. 2 is finally provided.

Thin-film forming techniques are generally used for forming an extremely thin film into an accurate film thickness, and most of such techniques require a relatively long time for the film formation. For example, the sputtering, which is an example of thin-film forming techniques, is performed in a vacuum chamber and requires the processing time corresponding to the intended film thickness, so that it is difficult to shorten the operation time. On the other hand, thick-film forming techniques generally require a relatively short time for the film formation. For example, the thick-film printing, which is an example of thick-film forming techniques, forms a thick film by applying paste as the material of a thick film to a predetermined region. With this technique, a thick film of a uniform thickness can be formed in a relatively short period of time. In the above-described manufacturing method, only the resistor layer 51 is formed by a thin-film forming technique, whereas the other parts, i.e., the common electrode 31, the individual electrodes 41, the partial glaze layer 2 and the protective layer 6 are formed by a thick-film forming technique. Therefore, the time taken for manufacturing the thermal printhead A1 can be shortened, and the manufacturing efficiency is enhanced.

Moreover, as compared with other techniques, the restriction on the material of the sputtering is relatively small, and the material can be selected flexibly. Therefore, the material suitable for forming a resistor layer 51 having good responsiveness to heating can be advantageously selected. Further, resistor layers 51 having the same quality and the same thickness can be formed repetitively. Therefore, the defective products can be reduced to increase the yield, and the quality control in the mass production is facilitated. The thermal printhead A1 can be properly manufactured by e.g. plating instead of sputtering.

The advantages of the thermal printhead A1 will be described below.

Since the resistor layer 51 is a thin film, the heat capacity is smaller than that of a resistor layer comprising a thick film. Therefore, the portion which is energized by the drive IC is quickly heated to a temperature suitable for the printing. Further, when the energization of the portion is stopped by the drive IC, the temperature drops quickly. In this way, since the responsiveness to heating and heat dissipation is good, trailing or a blur of a printing dot is unlikely to occur even when the ON/OFF switching of energization is performed at high speed. Therefore, the thermal printhead is suitable for high speed printing or high definition printing.

Further, unlike a resistor layer comprising a thick film, the resistor layer 51 comprising a thin film does not solely project largely upward. Therefore, during the printing, the protective layer 6 covering the resistor layer 51 is prevented from being pressed against the heat sensitive paper or ink ribbon with an excessive force. Therefore, sticking which causes unstable sheet feeding or abnormal noise can be prevented. Particularly, since the protective layer 6 covering the resistor layer 51 is finished to a smooth obverse surface and formed of glass having a relatively low coefficient of friction, the friction between the thermal printhead A1 and the heat sensitive paper or ink ribbon can be reduced, which also prevents sticking.

Since the common electrode 31 and the individual electrodes 41 comprise a thick film made of Au, these electrodes are superior in corrosion resistance to an electrode made of Al, for example. Therefore, even when the common electrode 31 and the individual electrodes 41 are exposed to the environment in which the electrodes are likely to be affected chemically or electrically in the long-term use, the electrodes do not corrode. Therefore, the deterioration of the print quality or unstable printing operation due to the contact failure or disconnection can be prevented, whereby the durability and reliability is improved. Moreover, the common electrode 31 and the individual electrodes 41 are formed below the resistor layer 51. Therefore, as compared with the structure in which these electrodes are formed above the resistor layer, the exertion of undesirable force from the outside to the electrodes or the corrosion of the electrodes are less likely to occur, which contributes to the enhancement of the durability and reliability of the entire thermal printhead.

Figure 6:
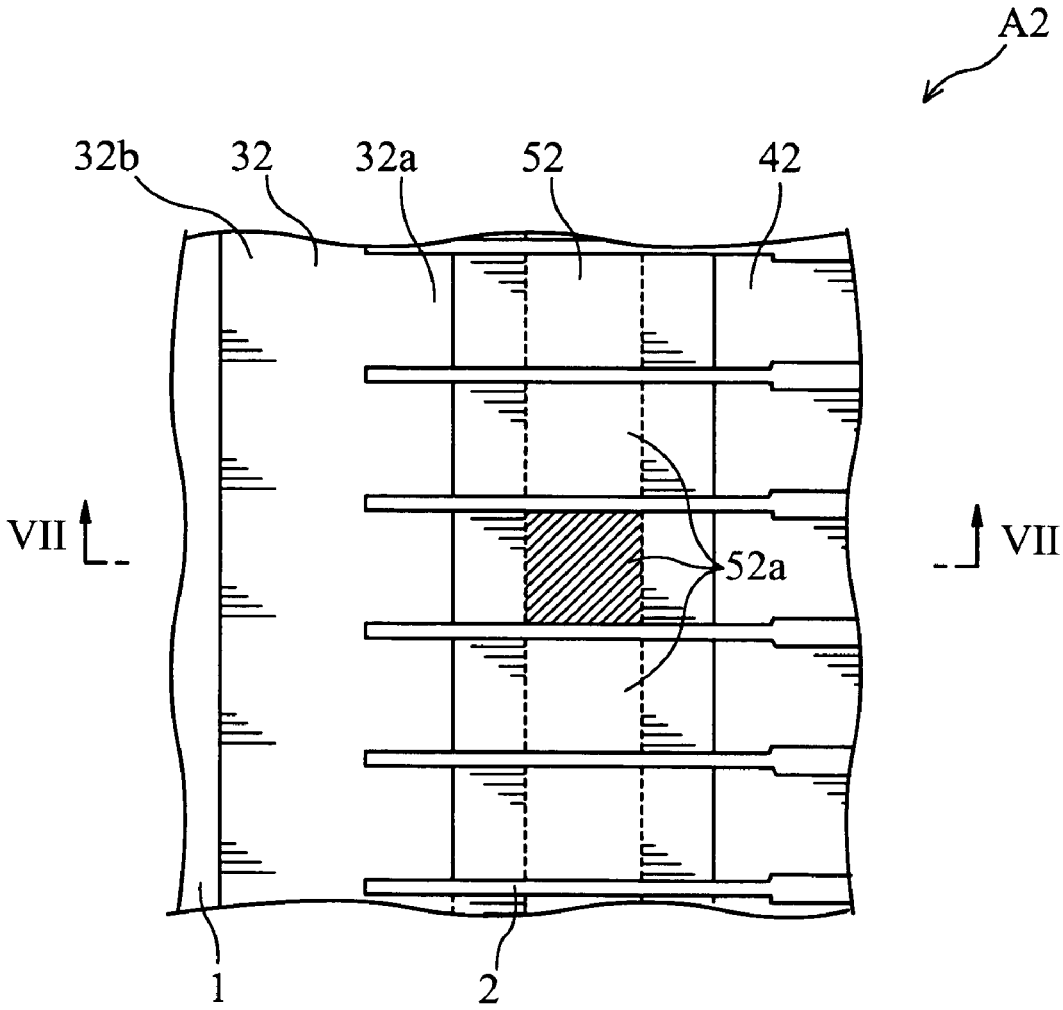
FIG. 6 is a plan view showing the principal portion of a thermal printhead according to a second embodiment of the present invention.
Figure 7:
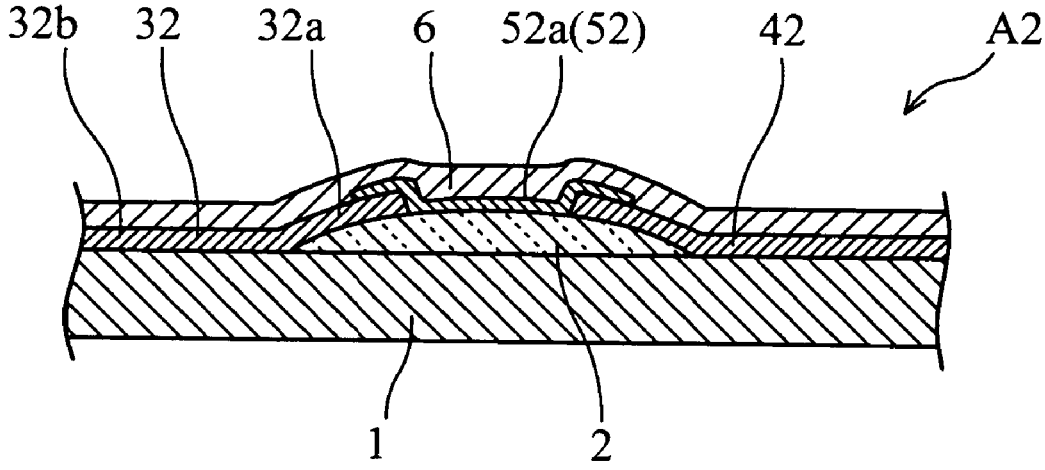
FIG. 7 is a sectional view taken along lines VII-VII in FIG. 6.
Figure 8:
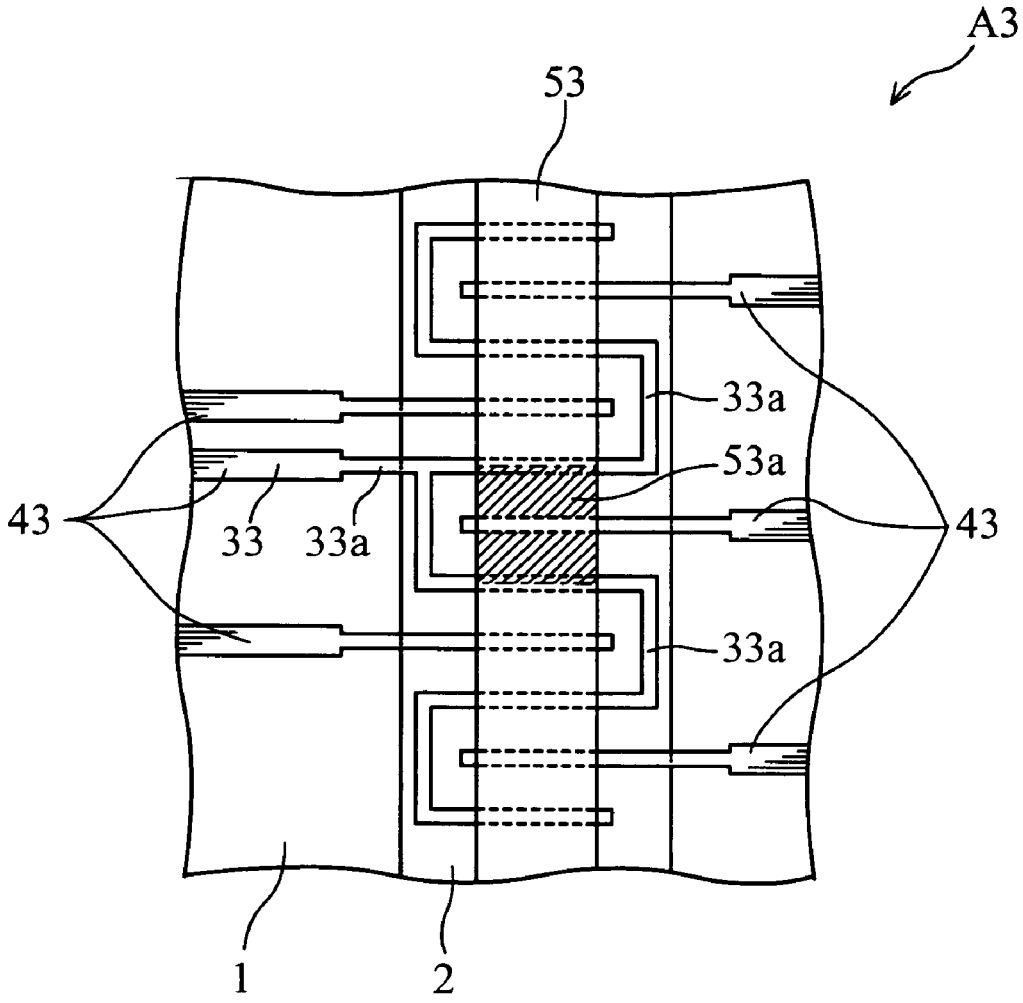
FIG. 8 is a plan view showing the principal portion of a thermal printhead according to a third embodiment of the present invention.
Figure 9:
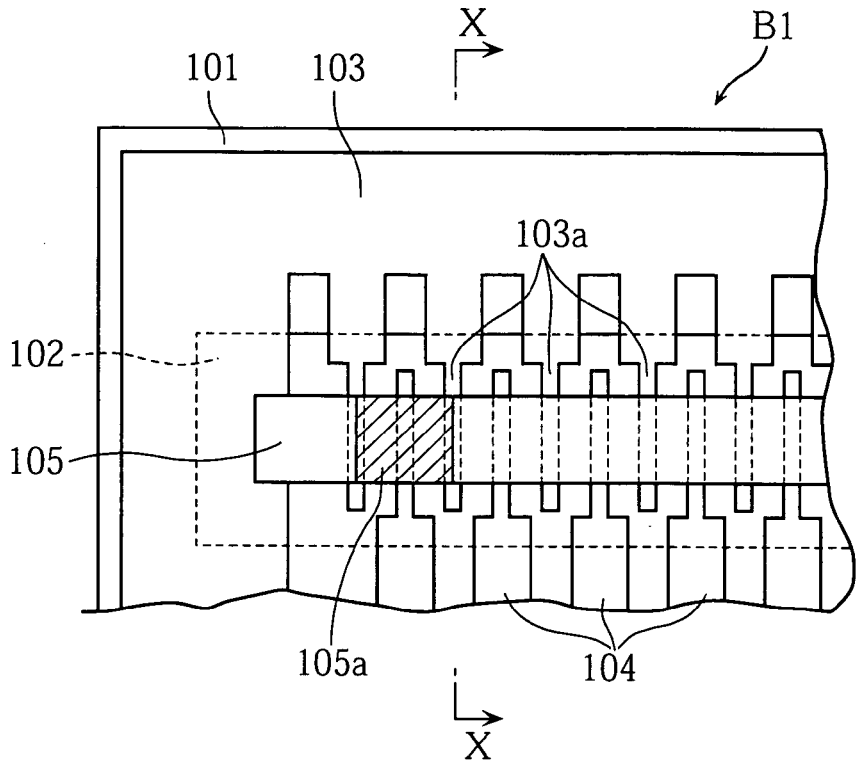
FIG. 9 PRIOR ART
FIG. 9 is a plan view showing the principal portion of an example of prior art thick-film thermal printhead.
Figure 10:
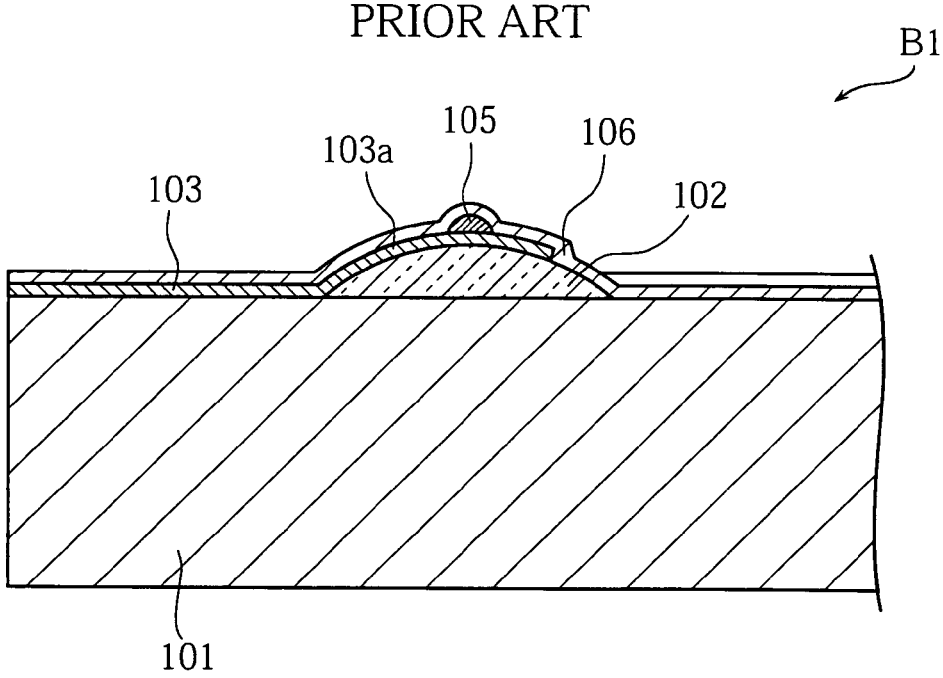
FIG. 10 PRIOR ART
FIG. 10 is a sectional view taken along lines X-X in FIG. 9.
Figure 11:
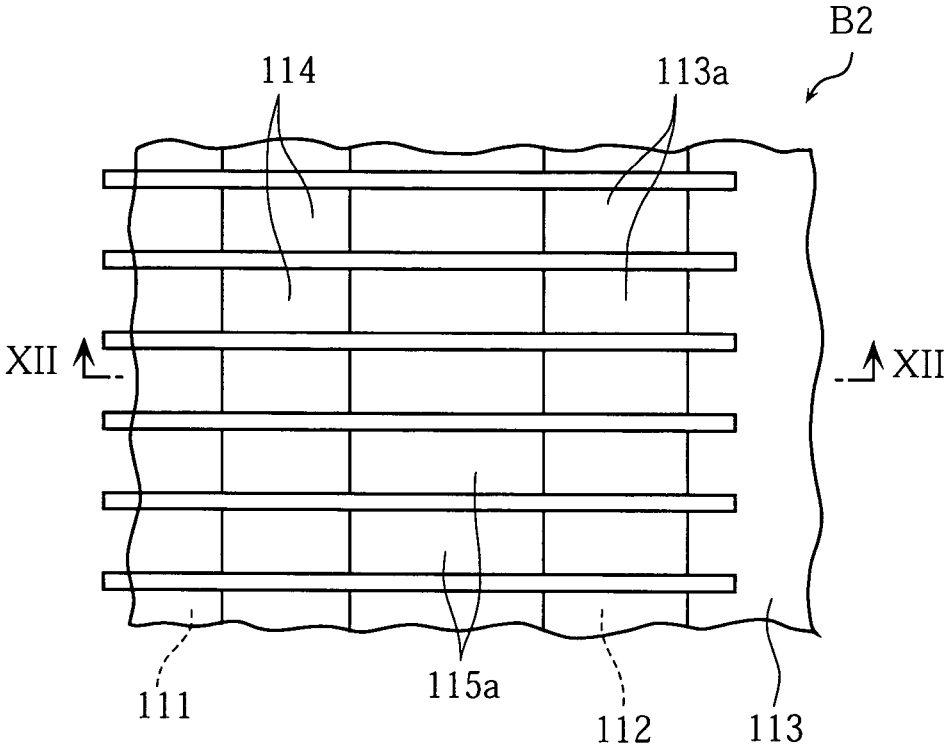
FIG. 11 PRIOR ART
FIG. 11 is a plan view showing the principal portion of an example of prior art thin-film thermal printhead.
Figure 12:
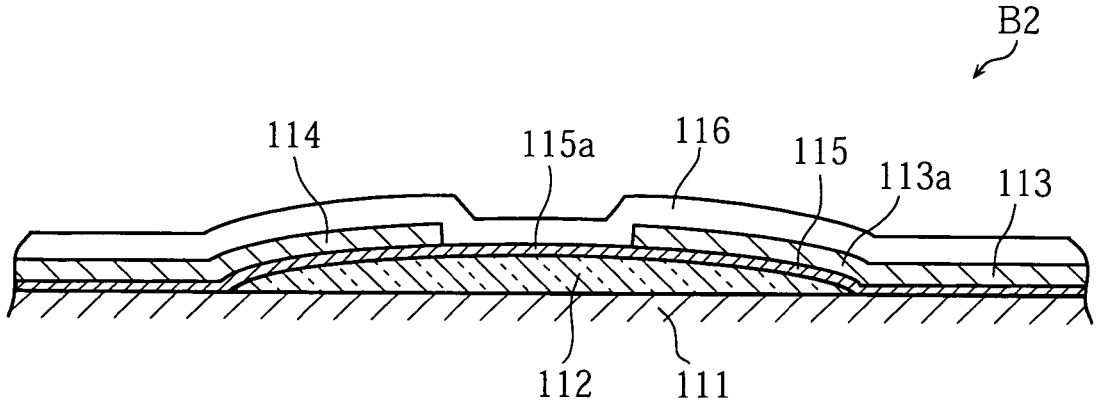
FIG. 12 PRIOR ART
FIG. 12 is a sectional view taken along lines XII-XII in FIG. 11.

FIGS. 6 and 7 show a thermal printhead A2 according to a second embodiment of the present invention, whereas FIG. 8 shows a thermal printhead A3 according to a third embodiment of the present invention. In FIGS. 6-8, the elements which are identical or similar to those of the first embodiment are designated by the same reference signs as those used for the first embodiment.

The thermal printhead A2 according to the second embodiment comprises an insulating substrate 1, a partial glaze layer 2, a common electrode 32, a plurality of individual electrodes 42, a resistor layer 52 and a protective layer 6. The protective layer 6 is not illustrated in FIG. 6. The second embodiment differs from the first embodiment in the shape and arrangement of the common electrode 32 and the individual electrodes 42 as well as the shape and arrangement of the resistor layer 52.

As better shown in FIG. 6, the common electrode 32 includes a common line 32*b* and a plurality of comb teeth 32*a*. Each of the individual electrodes 42 includes a front end which faces but is spaced from a corresponding one of the comb teeth 32*a*. The common electrode 32 and the individual electrodes 42 comprise a thick film formed by printing gold resinate paste, for example.

The resistor layer 52 is divided into a plurality of resistor portions 52*a* correspondingly to the plurality of comb teeth 32*a* and the plurality of individual electrodes 42. As better shown in FIG. 7, each of the resistor portions 52*a* partially covers, from above, the comb tooth 32*a* and the individual electrode 42 sandwiching the resistor portion and is electrically connected to the comb tooth and the individual electrode. Alternatively, opposite ends of each resistor portion 52*a* may lie under the corresponding comb tooth 32*a* and individual electrode 42. Similarly to the first embodiment, the resistor layer 52 comprises a thin film formed by sputtering using $TaSiO_2$ as the material, for example. When a voltage is applied to each of the selected individual electrodes 42 by the drive IC (not shown), current flows from that individual electrode to the corresponding comb tooth 32*a* through the resistor portion 52*a*. As a result, the resistor portion 52*a* is heated, whereby printing is performed.

According to the second embodiment, since the resistor portion 52*a* comprises a thin film similarly to the first embodiment, the responsiveness to heating and heat dissipation is good, which is suitable for high speed printing or high definition printing. Moreover, since the resistor portion 52*a* does not project largely upward, the sticking can be prevented. Further, in the second embodiment, the resistor layer 52 is divided into the plural rectangular resistor portions 52*a* spaced from each other. Therefore, even when a selected resistor portion 52*a* is energized, the adjacent resistor portion 52*a* is not energized (if it is not selected for energization). In this way, the selected resistor portion 52*a* can be solely heated reliably. Since the portion of heat sensitive paper or an ink ribbon, which is to be heated by the resistor portion 52*a*, is also rectangular, clear rectangular dot can be printed, whereby the print quality is improved.

The thermal printhead A2 of the second embodiment can be manufactured properly by a manufacturing method similar to that of the foregoing thermal printhead A1. In this case again, since only the resistor layer 52 is formed by a thin-film forming technique and other structural elements are formed by e.g. thick-film printing, the manufacturing efficiency is enhanced.

The thermal printhead A3 of the third embodiment shown in FIG. 8 is similar to the foregoing thermal printhead A1 in that portions of the comb teeth 33*a* extending from the common electrode 33 and portions of the individual electrodes 43 are alternately arranged in a predetermined direction and covered by the resistor layer 53 in the form of a strip, but differs from the thermal printhead A1 in the shape and arrangement of the comb teeth 33*a* and the individual electrodes 43.

The individual electrodes 43 extend alternately from two sides facing each other across the resistor layer 53 and are arranged in a row in the direction in which the resistor layer 53 extends. The comb teeth 33*a* of the common electrode 33 are bent back repetitively to surround respective front ends of the individual electrodes 43, and a plurality of portions thereof are arranged between two adjacent individual electrodes 43.

In this embodiment again, the same advantages as those of the foregoing thermal printhead A1 are provided. Further, with this structure, the number of comb teeth 33*a* extending from the common line to the resistor layer 53 can be reduced. Accordingly, the distance between the comb teeth 33*a* and the individual electrodes 43, which are covered by the resistor layer 53, can be narrowed, so that a smaller region of the resistor layer 53 can be heated. Therefore, the thermal printhead A3 is suitable for high definition printing.

The present invention is not limited to the foregoing embodiments and may be modified in various ways. For example, the thin-film forming technique is not limited to sputtering, and other techniques such as CVD or plating may be employed. Although the thick-film printing is preferable as the thick-film forming technique, the present invention is not limited thereto. The material of the resistor layer is not limited to $TaSiO_2$, and other materials such as ruthenium oxide may be used. The material of the common electrode and individual electrodes is not limited to Au, and other materials such as Ni or Cu may be used.

The invention claimed is:

1. A thermal printhead comprising: an insulating substrate; a common electrode formed on the insulating substrate and including a plurality of comb teeth; a plurality of individual electrodes formed on the insulating substrate; and a resistor layer formed on the insulating substrate and electrically connected to the comb teeth and the individual electrodes;

wherein the resistor layer comprises a thin film of $TaSiO_2$, whereas the common electrode and the individual electrodes comprise a thick film;

wherein the comb teeth and the individual electrodes have respective front ends facing and spaced from each other; and wherein the resistor layer is divided into a plurality of electrically-separated resistor portions correspondingly to the comb teeth and the individual electrodes, each of the resistor portions being positioned between the front end of one of the comb teeth and the front end of the corresponding one of the individual electrodes.

2. The thermal printhead according to claim 1, wherein the resistor layer has a film thickness of 0.05 to 0.2 μm, whereas the common electrode and the individual electrodes have a film thickness of 0.3 to 1.0 μm.

3. The thermal printhead according to claim 1, wherein the resistor layer, the common electrode and the individual electrodes are covered by a protective layer.

4. A thermal printhead comprising: an insulating substrate; a common electrode formed on the insulating substrate and including a plurality of comb teeth; a plurality of individual electrodes formed on the insulating substrate; and a resistor layer formed on the insulating substrate and electrically connected to the comb teeth and the individual electrodes;

wherein the resistor layer comprises a thin film, whereas the common electrode and the individual electrodes comprise a thick film;

wherein the comb teeth and the individual electrodes have respective front ends facing and spaced from each other; and wherein the resistor layer is divided into a plurality of electrically-separated resistor portions correspondingly to the comb teeth and the individual electrodes, each of the resistor portions being positioned between the front end of one of the comb teeth and the front end of the corresponding one of the individual electrodes.

* * * * *